US006306275B1

(12) United States Patent
Donovan, III et al.

(10) Patent No.: US 6,306,275 B1
(45) Date of Patent: Oct. 23, 2001

(54) METHOD FOR CONTROLLING ORGANIC MICELLE SIZE IN NICKEL-PLATING SOLUTION

(75) Inventors: Lawrence P. Donovan, III; Roger J. Timmer; David P. Hartrick, all of Lowell, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 0 days.

(21) Appl. No.: 09/540,226

(22) Filed: Mar. 31, 2000

(51) Int. Cl.[7] ..... C25D 21/18

(52) U.S. Cl. ..... 205/99; 205/101; 205/271; 205/698; 205/595

(58) Field of Search ..... 205/99, 101, 271, 205/272, 273, 274, 275, 276, 277, 278, 279, 280, 688, 698, 595

(56) References Cited

U.S. PATENT DOCUMENTS 3,839,165 * 10/1974 Strauss et al. ..... 204/49
4,081,336 * 3/1978 Eppensteiner et al. ..... 204/55 Y
5,897,763 * 4/1999 Elligsen et al. ..... 205/271

* cited by examiner

*Primary Examiner*—Margaret G. Moore
*Assistant Examiner*—Michael J Feely
(74) *Attorney, Agent, or Firm*—Price, Heneveld, Cooper, DeWitt & Litton

(57) ABSTRACT

A process for controlling the micelle size distribution of an alkylene oxide dispersion in a nickel-plating electrolyte is used to maintain the electrolyte in a condition suitable for producing nickel coatings having a uniform satin finish in which finish characteristics such as roughness depth are maintained within desired limits. The process involves steps of removing a portion of the electrolyte from the electroplating bath, filtering the alkylene oxide from the electrolyte removed from the electroplating bath, adding alkylene oxide to the electroplating bath, and returning the filtered electrolyte to the electroplating bath. The process removes larger alkylene oxide micelles from the electrolyte and replaces them with smaller micelles to maintain a desired micelle size distribution.

18 Claims, No Drawings

METHOD FOR CONTROLLING ORGANIC MICELLE SIZE IN NICKEL-PLATING SOLUTION

FIELD OF THE INVENTION

This invention relates to electroplating, and more particularly to controlling the organic micelle size in a nickel-plating solution.

TECHNICAL BACKGROUND OF THE INVENTION

A nickel coating having a satin finish is desired for various applications on account of its decorative appearance and low glare. Typical applications for satin finish nickel coatings include automotive parts and trim pieces, such as radiator grills and door handles; housings and trim pieces for various photographic and electronic devices, such as cellular telephones, portable video recorders and cameras; furniture components; and the like.

Satin metal coatings have been produced using several different methods. In one method, the surface of a metal substrate is blasted with an abrasive medium such as aluminum oxide to provide a textured surface, which is then electroplated with a bright nickel-plating and chromium electroplating. Another method involves deposition of a satin finish nickel directly without mechanical treatment. This method uses a typical nickel-plating bath, which is admixed with large amounts of insoluble powdery materials in the bath, such as kaolin, talcum, barium sulfate, etc., having a particle size of from about 0.1 to about 0.3 micron. These methods are not generally preferred because they are relatively expensive.

A heretofore preferred process of forming nickel deposits having a uniform satin finish involves the use of an electroplating bath containing a water soluble nickel salt, a primary polishing agent, and an amount of polyethylene oxide polypropylene oxide (PEOPPO) copolymer that is sufficient to form a finely divided dispersion in the bath electrolyte at the operating temperature. In order to achieve an acceptable roughness depth for the deposited coating, it is important that the PEOPPO is dispersed throughout the bath electrolyte in the form of finely divided droplets or micelles. A conventional freshly prepared bath electrolyte will typically exhibit the desired finely divided dispersion of the PEOPPO. However, after a period of time, the finely divided droplets or micelles will coalesce or agglomerate into larger micelles. As the average micelle size increases, the roughness depth of the deposited coatings increases. The stability of the PEOPPO micelles can be improved by adding stabilizing wetting agents such as branch chained alkyl sulfates or sulfonates. This will delay coalescence of the PEOPPO. However, if nothing further is done to counter the growth of the micelles due to coalescence, the roughness depth will increase to an unacceptable level. If this is allowed to occur, the coatings deposited on a substrate article will have an unacceptable roughness depth. Such articles will be rejected and discarded for unacceptable appearance. Further, the bath electrolyte may have to be treated to remove the larger micelles. Treatment of the electrolyte is undesirable because production is suspended while the electrolyte is being treated.

A method to control the uniformity of the satin finish is described in U.S. Pat. No. 3,839,165. The disclosed electroplating method involves continuously removing a portion of the electrolyte from the bath, passing the electrolyte through a heat exchanger in which cooled electrolyte is passed counter-currently and then through a cooling apparatus to cool the electrolyte below the turbidity point of PEOPPO alkylene oxide contained in the electrolyte, passing the cooled electrolyte counter currently through the heat exchanger and re-heating the electrolyte to the bath temperature, and adding the electrolyte back to the bath. During this process, the PEOPPO becomes soluble in the cool electrolyte and the desired finely dispersed micelles are regenerated upon heating the electrolyte back to the operating temperature. Although this method can substantially increase the useful life of the bath electrolyte, the method requires a large amount of energy to cool a portion of the electrolyte below the turbidity point of the alkylene oxide adduct and re-heat the electrolyte back to the bath operating temperature. Accordingly, a process of maintaining the required micelle size that uses less energy, and therefore is less expensive, is desired.

SUMMARY OF THE INVENTION

The invention provides a process for controlling the micelle size distribution of an alkylene oxide adduct dispersion in an electroplating bath. The process comprises the steps of removing a portion of the electrolyte from the electroplating bath, separating the alkylene oxide adduct from the electrolyte that was removed from the electroplating bath, adding additional alkylene oxide adduct to the electroplating bath, and returning the electrolyte to the electroplating bath. The invention provides a simple, economical method of controlling the micelle size of the alkylene oxide adduct dispersed in the plating electrolyte.

In another aspect of the invention, an electroplating process is provided. The electroplating process comprises the steps of providing a plating bath containing an electrolyte, the electrolyte containing a water soluble nickel salt, a primary polishing agent, and an alkylene oxide adduct that is dispersed in the electrolyte; passing an electric current from a substrate that is to be electroplated in the electrolyte, through the electrolyte, and to an electrode; removing a portion of the electrolyte from the electroplating bath; separating the alkylene oxide adduct from the electrolyte that has been removed from the electroplating bath; adding alkylene oxide adduct to the electroplating bath; and returning the electrolyte to the electroplating bath.

DESCRIPTION OF THE PREFERRED EMBODIMENTS

The electroplating process of this invention may be conducted in a conventional electroplating bath using an electrolyte containing a water soluble nickel salt, a primary polishing agent, and a PEOPPO.

Examples of suitable water soluble nickel salts that may be used include nickel sulfate hexahydrate and nickel chloride hexahydrate. Combinations of two or more water soluble nickel salts may be used if desired.

A suitable polishing agent is saccharin. Other polishing agents may also provide acceptable results. The polishing agents may be used individually or in combination, and may be employed in a conventional amount, such as from about 0.2 to about 10 grams per liter of the electrolyte.

Suitable alkylene oxide adducts of the formula $R_1[X(R_2O)_m(R_3O)_n]_p R_4$. Wherein X is selected from the group consisting of oxygen, sulfur and —NH—, $R_1$ and $R_4$ are selected from the group consisting of hydrogen and an organic radical, $R_2$ and $R_3$ are selected from the group consisting of ethylene and propylene, m and p are positive integers, and n is zero or a positive integer. The alkylene oxide adducts generally form turbid solutions at a temperature of from about 40° C. to about 75° C. Suitable alkylene oxide adducts, are commercially available and/or may be prepared using known processes. Other suitable alkylene oxide adducts include various polysiloxane polyether copolymers, having a polysiloxane block and one or more polyalkylene oxide blocks, such as a polyethylene oxide and/or polypropylene oxide block. Suitable polysiloxane polyether copolymers are well known and commercially available.

Typical electroplating bath temperatures for the process of this invention are from about 40° C. to about 75° C.

The nickel-electroplating bath of the invention may be used to form a coating having a roughness depth of from about 0.1 to about 6.0 microns. The deposited coatings have a fine to rough satin finish with excellent average thickness and dullness. The satin finish is obtained without any intermediate treatment. Substrates on which the coating may be deposited include iron, brass, copper, nickel, and polymeric materials that have been made conductive, etc. Other metals such as chromium, gold, silver and copper can be plated over the satin nickel deposit while retaining the satin finish.

The electroplating bath may be operated at a current density of from about 0.5 to 10 amps/dm$^2$. The bath electrolyte pH may be from about 3.0 to 5.1, and preferably from about 4.0 to about 4.8.

In accordance with the principles of this invention, a portion of the electrolyte is removed from the electroplating bath, stripped of PEOPPO through a filter medium, and returned to the electroplating bath along with fresh PEOPPO to account for PEOPPO removed in the filter medium, and thereby maintain the desired concentration of PEOPPO in the electroplating bath. The objective is to remove larger droplets or micelles of the PEOPPO and to replace the larger micelles with the finely dispersed (smaller) micelles developed when fresh PEOPPO is added to the electroplating bath. The result is that a micelle size distribution that is conducive to the production of high quality satin finish coatings having an excellent average thickness, dullness and roughness depth is maintained. The desired results may be achieved by continuously withdrawing a portion of the electrolyte from the bath, filtering the withdrawn portion to remove the PEOPPO, and returning the filtered electrolyte along with fresh PEOPPO to the bath. Alternatively, a portion of the electrolyte may be withdrawn from the bath on a periodic basis, or on some other basis as necessary, to remove larger micelles from the withdrawn portion and return the filtered portion of the electrolyte to the bath along with fresh PEOPPO to maintain the desired micelle size distribution in the electrolyte. Excellent results can be achieved by removing, stripping PEOPPO from, and replenishing (with fresh PEOPPO) from about 1/20 of the electrolyte volume in the bath to all of the electrolyte volume in the bath per hour, and more desirably from about 1/8 to about 1/3 of the electrolyte volume in the bath per hour. These rates of replenishment have been found to be effective for maintaining a bath capable of producing nickel deposits or coatings having a uniform satin finish.

Because the alkylene oxide adduct micelles have a lower density than water, the micelles tend to migrate upwardly. As a result, the average micelle size tends to increase in a direction from the bottom of the bath to the top of the bath. Therefore, it is highly preferred that the electrolyte that is filtered or otherwise stripped of the alkylene oxide adduct be removed from a level at or near the top of the bath so that larger micelles are preferentially removed from the bath and replaced with smaller micelles.

Useful filter media for removing alkylene oxide micelle material from nickel-plating electrolyte include cellulose filter media, cellulose filter media packed with an activated carbon, or other media packed with an activated carbon.

The following examples illustrate particular embodiments of the invention. However, it should be understood that the invention is not intended to be limited to the specific embodiments.

EXAMPLES

The basic nickel-electroplating bath used in the following examples had a bath volume of 3,000 gallons and consisted of an acid aqueous solution containing:

| | |
|---|---|
| Nickel Sulfate Hexahydrate | 40–45 oz/gal |
| Nickel Chloride Hexahydrate | 4–8 oz/gal |
| Boric Acid | 6.5–7.5 oz/gal |
| Saccharin | 5–10 g/liter |
| Sodium Allyl Sulfonate | 2.8–4.2 g/liter |
| Temperature | 125° F. |
| pH | 4.0–4.5 |

Example 1

0.002 g/liter of a polyethylene oxide polypropylene oxide co-polymer with a hydrophilic to lipophilic balance number between 7 and 12 was added to the nickel-plating electrolyte. Operation of the bath thus prepared over a current density range from 10 to 80 amps/ft$^2$ at 52° C. produced pore-free, ductile nickel deposits having a fine satin finish. After about an hour of operation, there were no discernable differences in the satin finish of the nickel deposit. Thereafter, an almost imperceptible grainy deposit occurred at 2 hours. After 4 hours, the deposit had bright areas and a large grainy pitted appearance.

Example 2

The process of Example 1 was repeated using the method of the invention. The nickel electrolyte overflowed a weir on the plating tank by a pump fitted with a variable speed motor. The solution was pumped at a rate of 10 gallons per minute through a filter comprised of cellulose filter media packed with activated carbon. The alkylene oxide was completely removed from the solution after filtration. The filtered nickel electrolyte, and a fresh replenishment of the polyethylene oxide polypropylene oxide co-polymer equivalent to the amount removed was injected into the electrolyte before returning it to the plating tank. The electrolyte was returned to the plating tank where it was discharged on the bottom of the tank. A precision flow meter was used to measure the electrolyte flow through the filter so that a precision feeder pump could be adjusted to add the correct amount of alkylene oxide replenishment material. The bath with this regeneration equipment produced deposits after 24 hours operation, which were identical to nickel deposits produced during the first hour of operation. The bath was operated continuously without interruption for 1 week without a change in the nickel deposit.

Example 3

0.002 g/liter of a polyethylene oxide-polypropylene oxide co-polymer with a hydrophilic to lipophilic balance number between 12 to 18 was added to the nickel-plating electrolyte.

The bath was operated at 52° C. over a current density rate of 10 to 80 amps/fe$^2$. Pore-free, free, ductile satin nickel deposit was produced. After 2 hours, the nickel deposits were gritty in appearance due to the formation of larger droplets of the alkylene oxide material.

Example 4

The plating process of Example 3 was repeated with removal and replenishment of the alkylene oxide material using the equipment described in Example 1. After 24 hours of operation the nickel deposits had the same uniform satin appearance.

These and other objects, advantages and features of the invention will be more fully understood and appreciated by reference to the Description of the Preferred Embodiments and the claims.

The embodiments of the invention in which an exclusive property or privilege is claimed are defined as follows:

1. A process for controlling the micelle size distribution of a dispersion in an operating plating bath, comprising:

(a) providing a plating bath containing an electrolyte, the electrolyte containing a water soluble nickel salt, a primary polishing agent, and an alkylene oxide adduct; and (b) continuously or intermittently performing the following steps during operation of the plating bath:

(i) removing a portion of electrolyte from the electroplating bath;

(ii) separating the alkylene oxide adduct from the electrolyte that was removed from the electroplating bath;

(iii) adding alkylene oxide adduct to the electroplating bath; and (iv) returning the electrolyte that was removed from the electroplating bath back to the electroplating bath.

2. The process of claim 1, wherein the electrolyte is removed from the electroplating bath and returned to the electroplating bath at a rate of from about 1/20 of the volume of the electrolyte in the plating bath per hour to the entire volume of the electrolyte in the plating bath per hour.

3. The process of claim 1, wherein removing a portion of the electrolyte from the electroplating bath, separating the alkylene oxide adduct from the electrolyte removed from the electroplating bath, and returning the electrolyte to the electroplating bath is done continuously.

4. The process of claim 1, wherein the portion of the electrolyte removed from the electroplating bath flows over a weir at or near the top of the plating bath, the alkylene oxide adduct is separated from the electrolyte by pumping the electrolyte through a filter media to filter the alkylene oxide adduct from the electrolyte, and wherein a flow meter is used to measure the electrolyte flow through the filter media so that a precision feeder pump can be adjusted to add an appropriate amount of alkylene oxide adduct to the electroplating bath to replenish the alkylene oxide adduct that was filtered from the electrolyte which was removed from the electroplating bath.

5. The process of claim 1, wherein separation of the alkylene oxide adduct from the electrolyte removed from the electroplating bath is achieved by pumping the electrolyte removed from the electroplating bath through a filter containing a cellulose filter media.

6. The process of claim 1, wherein separation of the alkylene oxide adduct from the electrolyte removed from the electroplating bath is achieved by pumping the electrolyte removed from the electroplating bath through a filter containing a filter media packed with activated carbon.

7. The process of claim 1, wherein separation of the alkylene oxide adduct from the electrolyte removed from the electroplating bath is achieved by pumping the electrolyte removed from the electroplating bath through a filter containing a cellulose filter media packed with activated carbon.

8. The process of claim 1, wherein the alkylene oxide adduct has the formula $R_1[X—(R_2O)_m(R_3O)_n]_pR_4$, wherein X is selected from the group consisting of oxygen, sulfur and —NH—, $R_2$ and $R_3$ are selected from the group consisting of ethylene propylene, m and p are positive integers, and n is zero or a positive integer, and $R_1$ and $R_4$ are selected from the group consisting of hydrogen and an organic radical.

9. The process of claim 1, wherein the alkylene oxide adduct is a polysiloxane polyether copolymer.

10. An electroplating process comprising:

(a) providing a plating bath containing an electrolyte, the electrolyte containing a water soluble nickel salt, a primary polishing agent and an alkylene oxide adduct; and (b) continuously or intermittently performing the following steps while passing an electric current from a substrate that is to be electroplated through the electrolyte to an electrode:

(i) removing a portion of the electrolyte from the electroplating bath;

(ii) separating the alkylene oxide adduct from the electrolyte removed from the electroplating bath;

(iii) adding alkylene oxide adduct to the electroplating bath; and (iv) returning the electrolyte that was removed from the electroplating bath back to the electroplating bath.

11. The process of claim 10, wherein the electrolyte is removed from the electroplating bath, and returned to the electroplating bath at a rate of from about 1/20 of the volume of the electrolyte in the plating bath per hour to the entire volume of the electrolyte in the plating bath per hour.

12. The process of claim 10, wherein the removing of a portion of the electrolyte from the electroplating bath, separating the alkylene oxide adduct from the electrolyte removed from the electroplating bath, and returning the electrolyte to the electroplating bath is done continuously.

13. The process of claim 10, wherein the portion of the electrolyte removed from the electroplating bath flows over a weir at or near the top of the plating bath, the alkylene oxide adduct is separated from the electrolyte by pumping the electrolyte through a filter media to filter the alkylene oxide adduct from the electrolyte, and wherein a flow meter is used to measure the electrolyte flow through the filter media so that a precision feeder pump can be adjusted to add an appropriate amount of alkylene oxide adduct to the electroplating bath to replenish the alkylene oxide adduct that was filtered from the electrolyte which was removed from the electroplating bath.

14. The process of claim 10, wherein separation of the alkylene oxide adduct from the electrolyte removed from the electroplating bath is achieved by pumping the electrolyte removed from the electroplating bath through a filter containing a cellulose filter media.

15. The process of claim 10, wherein separation of the alkylene oxide adduct from the electrolyte removed from the electroplating bath is achieved by pumping the electrolyte removed from the electroplating bath through a filter containing a filter media packed with activated carbon.

16. The process of claim 10, wherein separation of the alkylene oxide adduct from the electrolyte removed from the electroplating bath is achieved by pumping the electrolyte removed from the electroplating bath through a filter containing a cellulose filter media packed with activated carbon.

17. The process of claim 10, wherein the formula $R_1[X—(R_2O)_m(R_3O)_n]_pR_4$, wherein X is selected from the group consisting of oxygen, sulfur and —NH—, $R_2$ and $R_3$ are selected from the group consisting of ethylene and propylene, m and p are positive integers, and n is zero or a positive integer, and $R_1$ and $R_4$ are selected from the group consisting of hydrogen and an organic radical.

18. The process of claim 10, wherein the alkylene oxide adduct is a polysiloxane polyether copolymer.

* * * * *

UNITED STATES PATENT AND TRADEMARK OFFICE

CERTIFICATE OF CORRECTION

PATENT NO. : 6,306,275 B1
DATED : October 23, 2001
INVENTOR(S) : Lawrence P. Donovan, III et al.

It is certified that error appears in the above-identified patent and that said Letters Patent is hereby corrected as shown below:

Column 5,
Line 2, "amps/fe$^2$" should be -- amps/ft$^2$ --.

Signed and Sealed this

Nineteenth Day of March, 2002

*Attest:*

*Attesting Officer*

JAMES E. ROGAN
*Director of the United States Patent and Trademark Office*